United States Patent [19]

Stahlecker et al.

[11] Patent Number: 4,574,583

[45] Date of Patent: Mar. 11, 1986

[54] OPENING ROLLER ARRANGEMENT

[75] Inventors: Fritz Stahlecker, Bad Überkingen; Rolf Griesinger, Göppingen-Faurndau; Gerhard Fetzer, Süssen, all of Fed. Rep. of Germany

[73] Assignee: Hans Stahlecker & Fritz Stahlecker, Fed. Rep. of Germany

[21] Appl. No.: 619,126

[22] Filed: Jun. 11, 1984

[30] Foreign Application Priority Data

Jun. 11, 1983 [DE] Fed. Rep. of Germany ..... 3321236

[51] Int. Cl.[4] ..... D01H 7/895; D01G 19/10

[52] U.S. Cl. ..... 57/408; 19/112

[58] Field of Search ..... 57/408; 19/95, 97, 112

[56] References Cited

U.S. PATENT DOCUMENTS

| | | | |
|---|---|---|---|
| 2,908,047 | 10/1959 | Lehman | 19/112 X |
| 4,044,427 | 8/1977 | Ankrom et al. | 19/112 X |
| 4,208,767 | 6/1980 | Schmolke | 19/112 X |
| 4,249,286 | 2/1981 | Stalder | 57/408 X |
| 4,291,437 | 9/1981 | Yoshizawa et al. | 57/408 X |
| 4,296,527 | 10/1981 | Eadie | 57/408 X |
| 4,300,265 | 11/1981 | Heinen | 19/112 |
| 4,435,953 | 3/1984 | Schmid et al. | 57/408 |

*Primary Examiner*—Donald Watkins
*Attorney, Agent, or Firm*—Barnes & Thornburg

[57] ABSTRACT

An opening roller and a process for making an opening roller for open-end spinning machines is disclosed where wavy shaped toothed rings and intermediate rings are alternately slid on a preferably cylindrical part. The toothed rings and the intermediate rings are clamped between axial stops. It is provided that during the clamping of the toothed rings and the intermediate rings between the axial stops, the intermediate rings are plastically deformed. Thus it is achieved that without narrow manufacturing tolerances, the toothed rings and the intermediate rings rest against one another without gaps so that fibers cannot be caught during use of the opening roller.

24 Claims, 8 Drawing Figures

OPENING ROLLER ARRANGEMENT

BACKGROUND AND SUMMARY OF THE INVENTION

This invention relates to an opening roller arrangement for open-end spinning machines and a method of manufacturing same. Such opening roller arrangements include a cylindrical part with toothed rings and intermediate rings alternately slidably disposed thereon. The toothed rings and intermediate rings are clamped between axial stops, the radial surface of which facing one another being wavy to form a wavy configuration of the rings.

In practice, two different types of opening rollers are currently being used in open-end spinning machines which are chosen as a function of the fiber material to be spun. In the case of one type, the circumferential surface of the opening roller is covered with a plurality of needles. In the other type which is used much more frequently, a saw tooth wire is wound spirally around the circumference of the opening roller, the start and end of said winding being fixed at the opening roller. This saw tooth wire is either wound into a corresponding spiral groove of the roller or on the smooth surface thereof. These rollers that are wound with saw tooth wire present difficulties in the practical application because, on the one hand, they are expensive to manufacture and because, on the other hand, they are subject to poor wear characteristics. In order to permit the winding of the saw tooth wire on the roller, the saw tooth wire cannot be hardened or can only be hardened slightly making the hardening process more difficult in the area of the base of the teeth. The reduced hardness in the area of the base of the teeth also results in the fact that increased wear occurs at these points.

In order to avoid the difficulties of the saw-tooth wire wound opening rollers, it has also become known (French-PS No. 15 04 873) to slide toothed rings and intermediate rings alternately on a cylindrical part. In circumferential direction, these toothed rings and intermediate rings each have a wavy shape and are clamped between axial stops, the radial surfaces of which facing one another being provided with corresponding waviness. Thes stops are themselves secured in axial direction by means of flanges, where one of the flanges is made in one piece with the cylindrical part, while the other flange is screwed onto the cylindrical part. Opening rollers of this type have not been used in practice, apparently because the manufacturing costs are still very high and because there are further disadvantages as compared to the opening rollers wound with saw tooth wire. Extensive expenditures are required to construct the toothed disks as well as the intermediate rings and the surfaces of the axial stops facing one another with a wavy shape that is as identical as possible. Despite high manufacturing costs, it can nevertheless also not be avoided in series production that imprecisions occur between the wavy shape of the individual parts and also their thickness, so that after the assembly of the individual parts, open gaps remain between the toothed rings and the intermediate rings and also the stops. In this case, there is the considerable danger that fibers catch in these gaps which will rapidly lead to an obstruction of the opening roller in the housing surrounding it so that the configuration and possibly also the normally uninterrupted drive or the bearing means of the opening roller may be destroyed.

The invention is based on the objectives of providing a construction of an opening roller of the initially mentioned type which, without extensive manufacturing expenditures, can be built in such a way that gaps between the intermediate rings and the toothed rings are avoided.

This objective is achieved according to the invention by the fact that when clamping the toothed rings and the intermediate rings between the axial stops, the intermediate rings are made of a softer material than the toothed rings and are plastically deformed.

By means of the plastic deformation of the intermediate rings at the time of the clamping, these intermediate rings adapt themselves so smoothly to the toothed rings that possible previously existing gaps are completely closed. The thickness of the toothed rings and also that of the intermediate rings may differ with respect to one another or even over the circumference of a toothed ring or an intermediate ring without resulting in the formation of gaps in the finished opening roller. Also, the axial stops and their wavy surfaces do not have to be manufactured with extensively narrow tolerances without the danger of a formation of gaps. Based on the low requirements with respect to tolerances, the individual parts may simply and cost-effectively be manufactured in series production without high manufacturing expenditures.

In an advantageous arrangement of the invention, it is provided that the axial stops are fixed in their position with respect to one another after the deformation of the intermediate rings. This prevents that elastic forces that may still be effective lead to a loosening and thus to a formation of gaps.

In an advantageous arrangement of certain preferred embodiments of the invention, it is provided that the toothed rings are made of a spring steel and the intermediate rings are made of a deep-drawn metal alloy. This pairing of materials permits the desired plastic deformation of the intermediate rings during the clamping.

In an especially advantageous arrangement of the invention, it is provided that the toothed rings are hardened over their whole radial rings before their assembly. The hardening process for toothed rings of this type is much less expensive than the hardening process for saw tooth wire that differs over the radial rings, so that the hardening is considerably simplified and is also more suitable for series production. The base of the teeth which are susceptible to wear is also hardened in this arrangement of the invention.

In a further arrangement of the invention, it is also provided that the toothed rings have teeth, the bases of which are arranged on a diameter that is slightly larger than the outside diameter of the intermediate rings. By means of this arrangement, it is achieved that the intermediate rings do not extend into the area of the teeth of the toothed rings during their plastic deformation.

In a further arrangement of the invention, it is provided that the toothed rings are manufactured in a flat, plane shape and are elastically deformed during the clamping. This arrangement results in a further simplification of the manufacturing process because the toothed rings do not have to be preformed into a wavy shape so that one work step can be saved.

In an advantageous arrangement of the invention, it is provided that the toothed rings have the same thickness from the top of the teeth to the inside diameter. This reduces the material requirement for the toothed rings, while in addition the hardening process is simplified because of the same material thickness. It is especially favorable when the toothed rings have a thickness of about 0.2 mm.

In an especially advantageous arrangement of the invention, it is provided that the toothed rings are punched out of flat bars or strips. This results in a very cost-effective and still very precise manufacturing of the toothed rings which meets especially the requirements of a series production.

In an especially advantageous embodiment of the invention, it is provided that the intermediate rings are manufactured from an aluminum alloy. This results, on the one hand, in the desired deformability for mating of the intermediate rings and of the toothed rings, while, on the other hand, the intermediate rings are not threatened by corrosion.

Embodiments of the invention are contemplated wherein the intermediate rings are manufactured in a form that is preshaped in the form of waves. Since the intermediate rings are plastically deformed, this preshaping does not have to take place with excessive precision without disadvantages. However, in an especially advantageous development, it is provided that the intermediate rings are made in a flat shape. The intermediate rings which are relatively easily deformable, in comparison to the toothed rings, are then shaped into the wavy shape at the time of the clamping so that a preceding shaping becomes superfluous. This reduces the manufacturing expenses further. In practice, it was found that particularly good results are obtained when the intermediate rings are manufactured in a thickness that amounts to about 6 to 10 times the thickness of the toothed rings.

In a further arrangement of the invention, it is provided that the intermediate rings are manufactured in such a way that they have a larger thickness in the area of their outside diameter than in the area of their inside diameter before the clamping. This results in a plastic deformation mainly in the area of their outside diameter during the clamping which is decisive with respect to the fact that gaps existing before the clamping between the toothed rings and the intermediate rings are completely closed. In this case, it is especially advantageous when the intermediate rings have a trapezoid cross section which increases from the inside diameter to the outside diameter.

In a further arrangement of the invention, it is provided that the intermediate rings are punched out of a strip material. This results in an especially simple manufacturing of the intermediate rings with high precision that meets the requirements of series production. In this case, a deforming of the intermediate rings may take place simultaneously with the punching process, providing said intermediate rings with increased strength or thickness in the range of their outside diameter.

In a further development of certain embodiments of the invention, it is provided that the axial stops are made of the same material as the intermediate rings and have a thickness which also in the area of its wave hollows or valleys, amounts to at least twice the thickness of the intermediate rings. By means of this development, it is made possible to connect toothed rings directly to the axial stops, in which case, gaps that may possibly exist before the clamping are closed by the plastic deformation of the axial stops in their contact area at the toothed rings. Because of the increased wall thickness, it is ensured that a reshaping does not take place after the plastic deformation of the intermediate rings and also of the inside edges of the stops. It is advantageous in this case when the axial stops in an area having the wavy radial surface have an outside diameter that corresponds to the outside diameter of the intermediate rings, and when a collar connects with this area that has a diameter reaching at least to the tips of the teeth of the toothed rings. On the one hand, a protection of the teeth tips is provided, especially during the conveying of the opening rollers, while, on the other hand, the stops are strengthened further so that forces existing after the clamping do not threaten a loosening by the deforming of the stops.

In an advantageous arrangement of the invention, it is provided that one of the axial stops is made in one piece with the preferably cylindrical part, while the other stop is slid onto the cylindrical part after the toothed rings and the intermediate rings, with a narrow fit. This simplifies the manufacture of the stops and also the overall assembly. In order to avoid that the stop slid onto the part is loosened, it is provided in an expedient development that, after the sliding of the stop onto the cylindrical part and the plastic deformation of the intermediate rings, a plastic deformation takes place of the front sides of the stop and of the cylindrical part, in the area of the fit. By means of this plastic deformation—a so-called calking—an effective securing of the position takes place.

In another advantageous development of the invention, it is provided that the preferably cylindrical basic part is manufactured as a shell, is provided with the toothed rings, the intermediate rings and the second axial stop and is then detachably mounted on a roller-shaped basic part. Thus, an opening roller is created where the preferably cylindrical part which is provided with the set, i.e., the toothed rings, is constructed as an exchangeable component.

According to the invention, an opening roller is provided where on a preferably cylindrical part, alternately toothed rings made of spring steel and intermediate rings made of a more easily deformable material are arranged which each have a waviness in circumferential direction and which are clamped between axial stops, whose radial surfaces facing one another have a corresponding waviness. The intermediate rings under plastic deformation are smoothly adapted to the toothed rings. Based on this adaptation through plastic deformation, gaps that may previously have existed because of manufacturing tolerances between the toothed rings and the intermediate rings and also the axial stops, are closed. In this case, it is sufficient when only the axial stops have a waviness because the toothed rings and intermediate rings will then, during the clamping, elastically and plastically deform correspondingly and adapt to this waviness.

It is especially advantageous when the waviness has an overall amplitude in axial direction of about the thickness of the intermediate rings. The result is that a sliver is definitely combed out over its whole range without the height or depth of the waves having to be excessively large.

In an expedient embodiment of the invention, it is provided that four waves are provided that are evenly distributed over the circumference of the roller for each toothed ring. It was found in practice that this number of waves is sufficient, at which during a rotation of the opening roller, the fed sliver is combed out with four wave sections.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
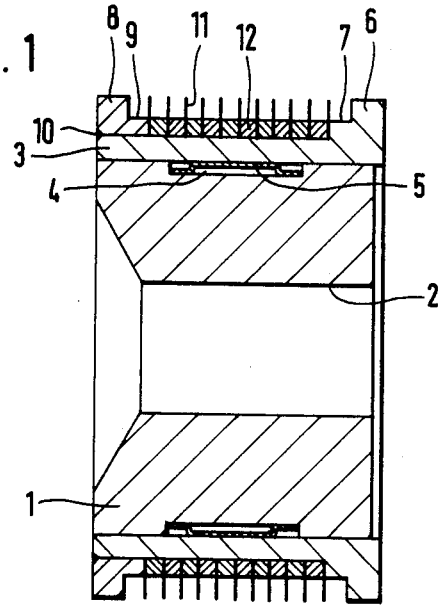
FIG. 1 is a sectional side schematic view through an opening roller constructed according to a preferred embodiment of the invention.

Referring to FIG. 1, the opening roller consists of a basic part 1 provided with a central borehole 2 for receiving a shaft, by means of which the opening roller is mounted and driven. A cylindrical shell 3 is fitted on the cylindrical outer circumference of the basic part 1. The basic part 1 is provided with a ring-shaped groove 4 in to which a profiled spring band 5 is placed providing a spring-actuated connection between the basic part 1 and the shell 3. The shell 3 is provided with a set of teeth used for opening or combing out a sliver of fibers.

Figure 2:
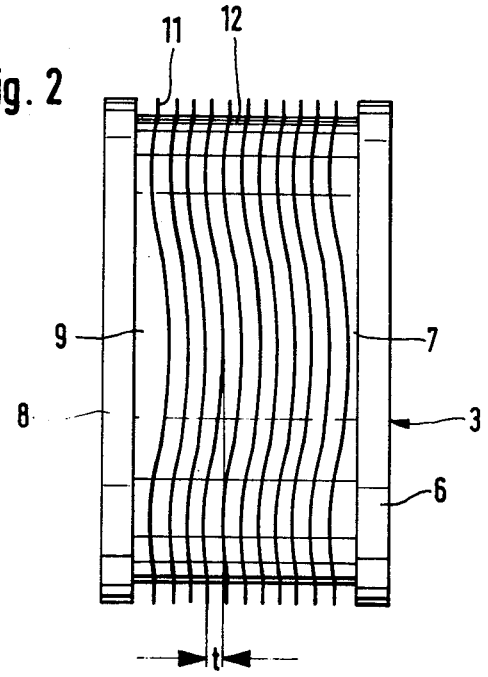
FIG. 2 is a side view of the opening roller according to FIG. 1.
Figure 4:
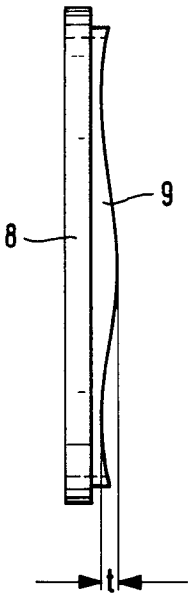
FIG. 4 is a view of the second stop to be slid on the part according to FIG. 3 in the opening roller construction according to FIG. 1.
Figure 3:
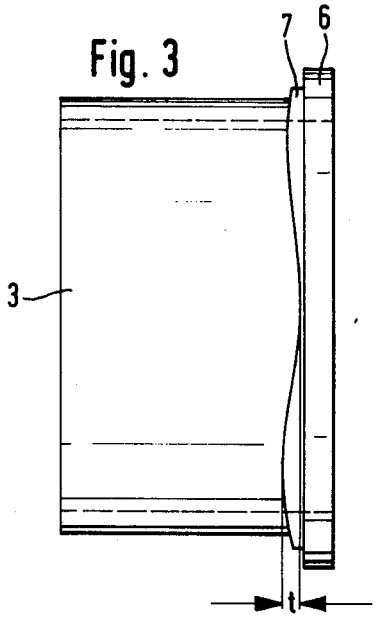
FIG. 3 is a side view of a shell-shaped part made in one piece with an axial stop and used for the reception of toothed rings, intermediate rings and another stop in the opening roller according to FIGS. 1 and 2.
Figure 5:
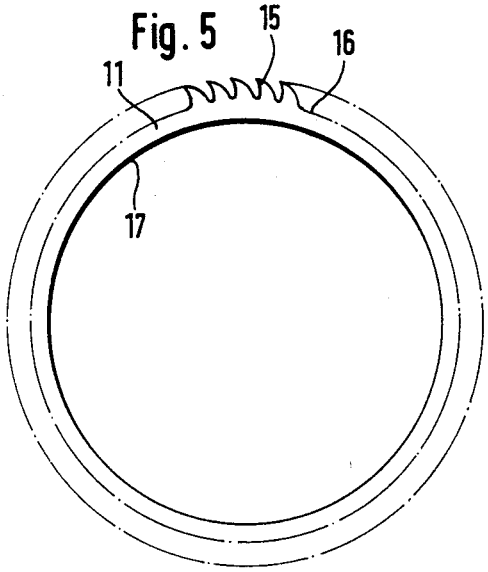
FIG. 5 is an axial schematic view of a toothed disk for use with the opening roller construction of FIG. 1.
Figure 6:
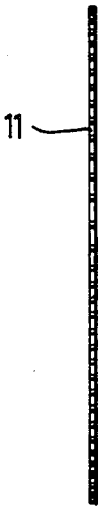
FIG. 6 is a lateral radial view of the toothed disk of FIG. 5.

Toothed rings 11 (FIGS. 5 and 6) are used for combing out the sliver and exhibit an inside diameter 17 corresponding to the outside diameter of the shell 3 and are slid onto the shell 3. Toothed rings 11 are evenly provided with teeth 15 over their circumference, the bases of said teeth 15 being disposed on a common diameter (circumference) 16. The toothed rings 11 have a waviness in the circumferential direction with amplitude t which corresponds to approximately the width of the intermediate rings 12 arranged between the toothed rings 11 when in the mounted condition shown in FIGS. 1 and 2. The toothed rings 11 as well as the intermediate rings 12 form four waves that are evenly distributed over the circumference so that during one rotation of the opening roller a sliver is combed out four times over the amplitude t of the wave in the individual ranges. By means of the amplitude t of the waviness corresponding to the width of the intermediate rings 12, it is ensured that the sliver is combed out over the complete working width of the opening roller.

At one front side, the shell 3 is provided with a flange 6 and a stop 7 connects thereto facing the rings, the radial surface of which stop 7 is constructed in a wavy shape. The shell 3 is constructed as a turning part so that, during the manufacture, it is not difficult to also produce the wavy radial surface of the stop 7. A slid-on stop 9 is located on the end of the shell 3 that is opposite the flange 6, said stop 9 being limited toward the outside by a flange 8 corresponding to the flange 6. The radial inside surface of the stop 9 facing the stop 7 is provided with a waviness corresponding to the waviness of the stop 7. The toothed rings 11 and the intermediate rings 12 alternately arranged to said toothed rings 11 are disposed between the two stops 7 and 9.

The toothed rings 11 are made from a strip-shaped spring steel, such as C60 G steel according to DIN 1544. The toothed rings 11 are punched out of this strip-shaped material and may be processed further, especially polished. Subsequently, they are hardened evenly over their whole radial range, for example, to a hardness of 60 Rockwell, so that an even hardness exists over the complete height of the teeth 15, from the bases 16 to the tips of the teeth. The thickness of the toothed rings 11 is about 0.2 mm.

Figure 7:
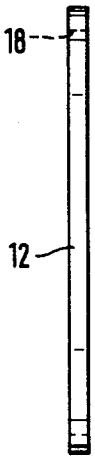
FIG. 7 is a lateral radial view of an intermediate ring for use with the opening roller construction of FIG. 1.

The intermediate rings 12 are made of a material that is relatively easily to deform as compared to the material of the toothed rings 11, such as the aluminum alloy Al Cu Mg Pb F35 according to DIN 1544. They are advantageously punched in a flat shape (FIG. 7) in their final form from a strip material.

During the assembly, the toothed rings 11 and the intermediate rings 12 are slid onto the cylindrical outer surface of the shell 3. In this case, the inside boreholes 17 and 18 of the toothed rings 11 and of the intermediate rings 12 are selected in such a way that an easy sliding fit exists with respect to the outer circumference of the shell 3. After the toothed rings 11 and the intermediate rings 12 are slid onto the shell 3, the stop 9 with the flange 8 is pushed on the shell 3. Subsequently, a pressing force acting in axial direction is applied between the stops 7 and 9, by means of which the toothed rings 11 and the intermediate rings 12 are deformed corresponding to the wavy shape of the radial surfaces of the stops 7 and 9 disposed opposite one another. In this case, the toothed rings 11 made of a spring steel receive an elastic deformation, while the intermediate rings 12 are already deformed plastically. In this case, the axial pressing force is chosen in such a way that the intermediate rings 12, in the area of their edges which on the front side are opposite the toothed rings 11, clearly exceed the yielding point so that they adapt smoothly to the toothed rings 11. By means of this plastic deformation of the intermediate rings 11, any gaps are avoided between the toothed rings 11 and the intermediate rings 12, which otherwise may be caused by manufacturing tolerances and/or differences in the material thickness.

The shell 3 with the stop 7 and the flange 6 as well as the stop 9 with the flange 8 are also made from a material that is relatively easy to deform in comparison to the spring steel of the toothed rings; they may especially be made of the same material as the one used for the intermediate rings 12. This makes it possible to always connect directly to the stops 7 and 9, the toothed rings 11 to which the stops 7 and 9 which deform plastically in their edge areas will then adapt themselves flushly, so that here also no gap can occur. The stops 7 and 9 have a thickness in the axial direction which is dimensioned in such a way that the desired deforming of the toothed rings 11 and the intermediate rings 12 in the wavy shape is obtained and that they are also sufficiently stable with respect to retroacting forces caused by elastic deformations. The stops 7 and 9 in axial direction therefore have a thickness (including the flange 6 and 8) which amounts to at least double the wall thickness of the intermediate rings 12 and preferably at least five times the wall thickness. An additional stiffening of the stops 7 and 9 is obtained by means of the flanges 6 and 8 having a larger outside diameter which slightly projects beyond the outside diameter in the range of the tops of the teeth of the toothed rings 11.

The stop 9, with a narrow fit, is pushed onto the shell 3, for example, with a press fit. In order to obtain an additional safety measure against a pushing-apart after the pressing force is removed, a plastic deformation 10 takes place in the area of the fit, between the stop 9 and the shell 3, so that not only a spring-actuated but also a form-fitting securing of the position of the stop 9 on the shell 3 is obtained.

Figure 8:
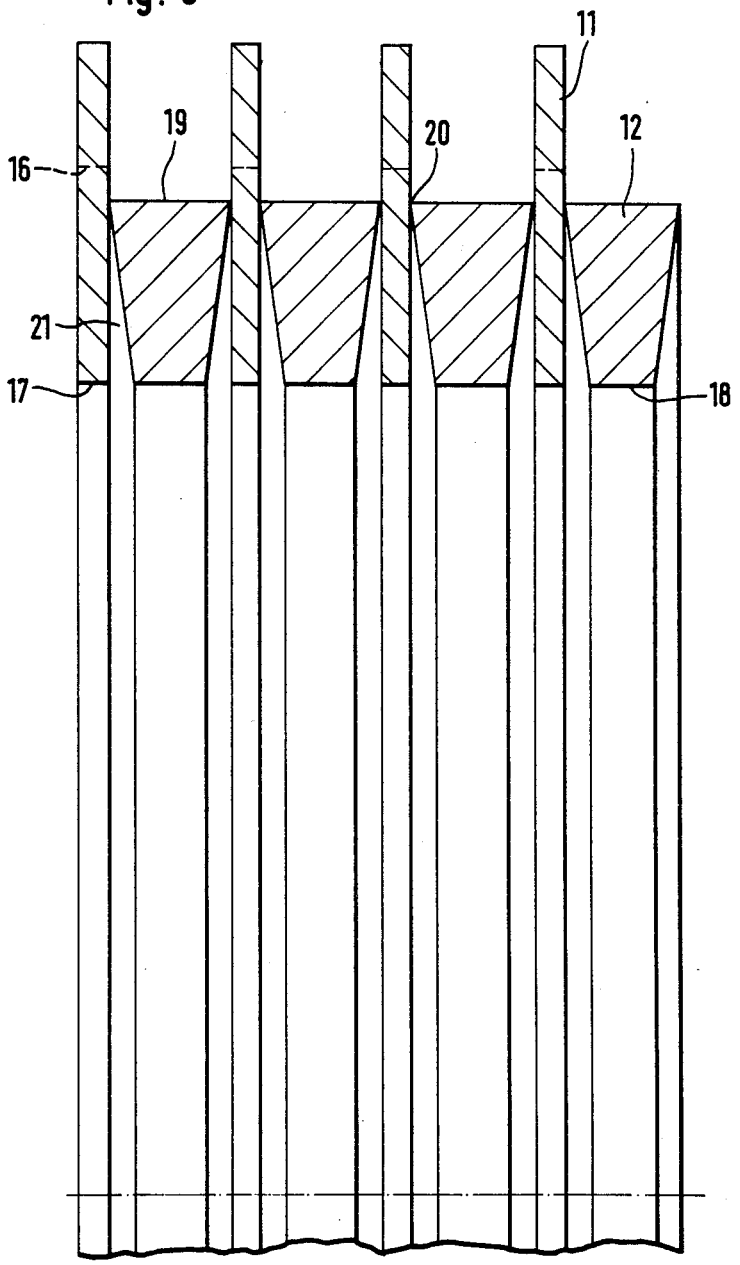
FIG. 8 is an enlarged lateral schematic view depiction showing intermediate rings and toothed rings arranged next to one another before the clamping and the plastic deforming of the intermediate rings to form the opening roller construction of FIG. 1 but with a different embodiment of intermediate rings.

Since it is most important that no open gaps exist between the toothed rings 11 and the intermediate rings 12 in the area of the outside diameter 19 of the intermediate rings 12, the intermediate rings 12, in the embodiment corresponding to FIG. 8, are developed in such a way that, in the area of their outside diameter 19, they have a larger thickness than in the area of their inside diameter. In the case of the embodiment according to FIG. 8, the intermediate rings 12 have a trapezoid cross section that widens in the readial direction. Before the pressing-together, the intermediate rings 12 therefore only rest against the front sides of the toothed rings 11 on a circular line 20, while a wedge-shaped gap 21 exists. By means of this development, it is possible to use lower forces for the clamping because it is sufficient when the intermediate rings 12 are deformed in the area of their outside diameters 19, i.e., in the area of the tangent 20, in order to avoid the creation of gaps. However, in practice, it is endeavored to drive the deformation so far that also the wedge-shaped gap 21 which is not open toward the outside, is covered completely.

The bases of the toothed rings 11 are located on a circumference 16 which is slightly larger in diameter than the outside diameter 19 of the intermediate rings 12, so that it is ensured that the intermediate rings 12, in the case of a plastic deformation, do not deform into the area of the bases of the teeth.

The toothed rings 11 in especially preferred practical embodiments have a thickness in the magnitude of 0.2 mm. The height of the teeth is chosen to be in the magnitude of 2.5 to 3.5 mm. The wall thickness of the intermediate rings 12 is chosen to be in the magnitude of between 1.8 to 2 mm and its dimension in axial direction is about 2 to 4 mm.

The shell 3 preferably has a cylindrical outside diameter and correspondingly, the toothed rings 11 and the intermediate rings 12 have a circular inside diameter 17 and 18. It is also contemplated to provide the shell 3 with an outer surface that differs from the cylindrical shape and to then adapt the inside recesses of the toothed rings 11 and the intermediate rings 12 as well as of the stop 9. In this case, it could be provided that a profiling is chosen which is developed in such a way that the stop 9 can only be pushed onto the shell 3 when the wavy surface of the stop 9 coincides exactly with the wavy surface of the stop 9, i.e. when a wave crest and a wave hollow are opposite one another.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An opening roller assembly comprising:

a cylindrical support part;

a plurality of toothed rings and intermediate rings arranged alternately on the cylindrical support part, the toothed rings being made of spring steel or the like, the intermediate rings being made of material that is more easily plastically deformable than is the material of the toothed rings;

said rings exhibiting a wave shaped pattern around the circumference of the cylindrical support part;

and axial stop means clampingly engaging the rings therebetween with the intermediate rings being plastically deformed to form a smooth connection with the toothed rings.

2. An opening roller assembly according to claim 1, wherein the wave shaped pattern has a wave amplitude in the axial direction of the cylindrical support part which is approximately equal to the thickness of the respective intermediate rings.

3. An opening roller assembly according to claim 2, wherein the wave shaped pattern includes four waves distributed evenly around the circumference of the cylindrical support part.

4. An opening roller assembly according to claim 1, wherein the toothed rings are made of a spring steel and the intermediate rings are made of a deep-drawn metal alloy.

5. An opening roller assembly according to claim 1, wherein toothed rings are provided with teeth, the bases of which teeth are arranged on a diameter that is slightly larger than the outside diameter of the intermediate rings.

6. An opening roller assembly according to claim 1, wherein the toothed rings are made in a flat shape and are elastically deformed during clamping between the axial stop means.

7. An opening roller assembly according to claim 1, wherein the toothed rings have the same thickness from the tips of the teeth to the inside diameter.

8. An opening roller assembly according to claim 1, wherein the toothed rings have a thickness of about 0.2 mm.

9. An opening roller assembly according to claim 1, wherein the toothed rings are formed by being punched out of flat bars or strips.

10. An opening roller assembly according to claim 1, wherein the intermediate rings are made from an aluminum alloy.

11. An opening roller assembly according to claim 1, wherein the intermediate rings are made in a wavy preformed shape.

12. An opening roller assembly according to claim 1, wherein the intermediate rings are made in a flat shape.

13. An opening roller assembly according to claim 1, wherein the intermediate rings are constructed with an axial thickness amounting to about 6 to 10 times the thickness of the toothed rings.

14. An opening roller assembly according to claim 1, wherein the intermediate rings are constructed in such a way that in the area of their outside diameter, they have a larger axial thickness than in the area of their inside diameter.

15. An opening roller assembly according to claim 14, wherein the intermediate rings have a trapezoid cross section enlarging from the inside diameter to the outside diameter.

16. An opening roller assembly according to claim 1, wherein the intermediate rings are punched out of a strip material.

17. An opening roller assembly according to claim 1, wherein the axial stop members are made of the same material as the intermediate rings and have a thickness which, also in the area of their wave hollows, amount to at least double the thickness of the intermediate rings.

18. An opening roller assembly according to claim 1, wherein the axial stop members have an outside diameter that corresponds to the outside diameter of the intermediate rings and that collar means at the axial stops has an outside diameter that reaches at least to the tips of the teeth of the toothed rings.

19. An opening roller assembly according to claim 1, wherein one of the axial stop members is constructed as a unitary one piece part with the cylindrical part, while the other axial stop member is pushed onto the part with a tight fit after the toothed rings and the intermediate rings.

20. An opening roller assembly according to claim 19, wherein after the sliding of the stop member on the cylindrical part and the plastic deformation of the intermediate rings, a plastic deformation on the front sides of the stop member and of the cylindrical part takes place in the area of the fitting connection.

21. An opening roller assembly according to claim 1, wherein the preferably cylindrical part is constructed as a shell, is provided with the toothed rings, the intermediate rings and the second axial stop and is then detachably mounted on a basic roller-shaped part.

22. An opening roller assembly according to claim 4, wherein the toothed rings are hardened before the assembly over their complete radial range.

23. An opening roller assembly according to claim 4, wherein toothed rings are provided with teeth, the bases of which teeth are arranged on a diameter that is slightly larger than the outside diameter of the intermediate rings.

24. An opening roller assembly according to claim 23, wherein the toothed rings are made in a flat shape and are elastically deformed during clamping between the axial stop means.

* * * * *